US008066059B2

(12) United States Patent
Ferguson et al.

(10) Patent No.: US 8,066,059 B2
(45) Date of Patent: Nov. 29, 2011

(54) METHODS AND DEVICES FOR ONE TRIP PLUGGING AND PERFORATING OF OIL AND GAS WELLS

(75) Inventors: Andrew M. Ferguson, Oklahoma City, OK (US); Stanley Wayne Loving, Blanchard, OK (US); Bryan Franklin McKinley, Oklahoma City, OK (US); Dale Norman, Spring, TX (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 625 days.

(21) Appl. No.: 11/372,527

(22) Filed: Mar. 9, 2006

(65) Prior Publication Data

US 2006/0201675 A1 Sep. 14, 2006
US 2011/0114316 A2 May 19, 2011

Related U.S. Application Data

(60) Provisional application No. 60/661,262, filed on Mar. 12, 2005.

(51) Int. Cl.
*E21B 43/114* (2006.01)

(52) U.S. Cl. ..... 166/55.2; 166/169; 166/194; 166/222; 166/318

(58) Field of Classification Search ..... None
See application file for complete search history.

(56) References Cited

U.S. PATENT DOCUMENTS

| | | | | |
|---|---|---|---|---|
| 1,279,333 | A | 9/1918 | Green | |
| 2,828,107 | A | 3/1958 | Bobo | |
| 3,066,735 | A | 12/1962 | Zingg | |
| 3,116,800 | A | 1/1964 | Kammerer | |
| 3,795,282 | A | 3/1974 | Oliver | |
| 4,518,041 | A | 5/1985 | Zublin | |
| 4,638,873 | A * | 1/1987 | Welborn | 175/73 |
| 4,967,841 | A | 11/1990 | Murray | |
| 5,318,123 | A | 6/1994 | Venditto et al. | |
| 5,533,571 | A | 7/1996 | Surjaatmadja et al. | |
| 6,085,843 | A * | 7/2000 | Edwards et al. | 166/297 |
| 6,491,098 | B1 * | 12/2002 | Dallas | 166/297 |
| 6,520,255 | B2 * | 2/2003 | Tolman et al. | 166/281 |
| 2002/0092650 | A1 * | 7/2002 | Tolman et al. | 166/298 |
| 2006/0027368 | A1 * | 2/2006 | Manke et al. | 166/298 |

FOREIGN PATENT DOCUMENTS

EP 452126 A2 * 10/1991

OTHER PUBLICATIONS

U.S. Appl. No. 12/245,210, entitled "Abrasive Perforator Tool," filed Oct. 3, 2008, which is a continuation-in-part of the instant application. This application currently is pending; an Office action finally rejecting the claims was issued on Dec. 22, 2010. The original specification, including claims and drawings, of U.S. Appl. No. 12/245,210, entitled "Abrasive Perforator Tool," filed Oct. 3, 2008. The final Office action issued on Dec. 22, 2010, in U.S. Appl. No. 12/245,210, entitled "Abrasive Perforator Tool," filed Oct. 3, 2008. Applicant's most recent Amendment entered on Aug. 30, 2010, in U.S. Appl. No. 12/245,210, entitled "Abrasive Perforator Tool," filed Oct. 3, 2008.

* cited by examiner

*Primary Examiner* — Zakiya W Bates
(74) *Attorney, Agent, or Firm* — Mary M. Lee

(57) ABSTRACT

A tubing conveyed tool for use in perforating a well bore utilizing abrasive perforating techniques. The perforating tool is particularly useful in non-vertical wells. The perforating tool is designed to permit running and setting a bridge plug, and then perforating the well bore without requiring the removal of the tool string. An eccentric weight bar can also be used to allow for directional perforating in non-vertical wells. The eccentric weight bar uses gravity to cause the bar to rotate to a predetermined position.

10 Claims, 8 Drawing Sheets

METHODS AND DEVICES FOR ONE TRIP PLUGGING AND PERFORATING OF OIL AND GAS WELLS

CROSS-REFERENCE TO RELATED APPLICATIONS

This application claims priority from a provisional application entitled "One Trip Plugging and Perforating Method," filed on Mar. 12, 2005, Ser. No. 60/661,262.

FIELD OF THE INVENTION

The instant invention relates to devices and methods for setting bridge plugs and perforating hydrocarbon wells. More particularly, the invention describes new devices that may be conveyed on tubing to allow setting a bridge plug and perforating the well in a single tubing trip.

BACKGROUND OF THE INVENTION

After drilling a well for hydrocarbons, it may be necessary to perforate the walls of the well to facilitate flow of hydrocarbons into the well. Wells require perforation because the drilling process causes damage to the formation immediately adjacent to the well. This damage reduces or eliminates the pores through which the oil or gas would otherwise flow. Perforating the well creates a channel through the damage to undamaged portions of the formation. The hydrocarbons flow through the formation pores into the perforation channels and through the perforation channels into the well itself.

In addition, steel casing may be set within the hole adjacent to the hydrocarbon bearing formation. The casing forms a barrier that prevents flow of the hydrocarbons into the well. In such situations, the perforations go through the casing before entering the formation.

Traditional methods of perforating the well (both casing and the formation) involved lowering tools that contain explosive materials into the well adjacent to the hydrocarbon bearing formation. Discharge of the explosive would either propel a projectile through the casing and into the formation or, in the case of shaped charges, directly create a channel with explosive force. Such devices and methods are well known in the art.

In vertical wells, gravity may be used to lower the perforating device into position with wireline being used to hold the device against gravity and retrieve the device after discharge. For lateral wells, which may be horizontal or nearly horizontal, gravity may only be used to lower the perforating device to a point where the friction of the device against the well bore overcomes the gravitational force. The perforating device must then be either pushed or pulled along the lateral portion of the well until the device reaches the desired location.

For wireline conveyed devices, motorized devices called tractors, which are well known in the art, are sometime used to pull the explosive perforating device into position. Tractors, however, can be unreliable and may be damaged by the explosive force of the perforating device.

Another method for positioning the perforating device is with coiled tubing. This technique is sometimes called tubing conveyed perforation or TCP. One advantage of TCP is that the perforating device is attached to the end of the coiled tubing and the coiled tubing pushes the device into the proper location. For lateral wells, the tubing will often contain wireline within the coiled tubing. The wireline can be used to carry an electric current to discharge the explosive contained within the perforating device.

Another advantage of tubing conveyed perforation is the ability to set a hydraulic bridge plug at a location in the well below (distal in relation to the wellhead) the relevant hydrocarbon bearing formation, or between two hydrocarbon bearing formations. This allows the producing zones of the well to be isolated. Once the bridge plug is set, the perforating device can be fired and any fluids from the newly perforated zone will not flow into any regions separated by the bridge plug.

Special explosive perforating devices have been developed that contain a channel for the flow of hydraulic fluid. Thus, the bridge plug can be set, and the perforating device discharged with a single trip of the coiled tubing. Without a flow channel in the perforating device, the tubing end would have to return to the surface, have a perforating device attached, and return to the hydrocarbon bearing formation before perforation can be performed. Thus, the ability to set the bridge plug and perforate in a single trip saves significant time.

While the perforating devices used in prior art methods of TCP have provided the ability to set a bridge plug and perforate the well in a single trip, the methods are still limited. For example, the length of the perforated zone is limited to the length of perforating gun assembly. In other words, to perforate along a 100 foot length of the well, the perforating gun assembly must be at least 100 feet long. This does not include the length of the bridge plug at the end of the gun assembly. However, the increased length also increases the mass of the gun assembly, making the assembly more difficult to deploy in horizontal wells.

Long gun assemblies have an additional disadvantage. The gun assembly is introduced into the well using a lubricator. The lubricator is a device attached to the well head below the coiled tubing or wireline injector, depending on whether tubing or wireline is used to convey the gun assembly. The length of the lubricator is directly related to the length of the gun assembly. If the gun assembly is 100 feet long, the lubricator is at least the same length. In such a case, the injector, either coiled tubing or wireline, above the lubricator is at least 100 feet in the air which creates difficulties running hydraulic hoses, control lines, and with maintenance should the injector head fail.

One alternative to the explosive perforating device is an abrasive perforating device. Abrasive perforating devices direct a concentrated stream of fluid against the casing and, once the casing is penetrated, the surrounding formation. The fluid contains a suspended solid or solids, such as sand, to wear away the metal and rock of the casing and formation. Abrasive perforation is well known in the art.

The operator merely increases flow of the abrasive fluid to begin perforation and decreases flow to stop perforation. The depth and size of perforations are controlled by the fluid pressure and by the length of perforation time. With an abrasive perforator, perforations can be made across a long interval of the well in a single trip and without increasing the size of the tool string. Thus abrasive perforators avoid the problems created by the increased size and weight of long gun assemblies.

Prior art abrasive perforation devices have been run on the end of tool strings. Thus, the fluid channel ends at the bottom of the abrasive perforating device. This configuration has prevented the addition of other tools, such as bridge plugs, below the abrasive perforating device. As mentioned above, running a bridge plug or other tool below the abrasive perforator is sometimes desirable.

SUMMARY OF THE INVENTION

The present disclosure describes a number of embodiments of a tubing conveyed abrasive perforating tools that utilizes sliding sleeves or the like to permit fluid communication through the tool to a bridge plug. The fluid communication to the bridge plug permits setting the bridge plug. Once the bridge plug is set, the sliding sleeve or similar device is actuated to close the fluid path through the perforating tool, and open the fluid paths to the perforating orifices. The tool can then be used for abrasive perforating moving up the well bore for as many perforations as are needed. With the addition of an eccentric weight bar or the like, the perforating can be performed directionally.

BRIEF DESCRIPTION OF THE DRAWINGS

The forgoing summary, preferred embodiments, and other aspects of subject matter of the present disclosure will be best understood with reference to a detailed description of specific embodiments, which follows, when read in conjunction with the accompanying drawings, in which.

DETAILED DESCRIPTION

Figure 1A:
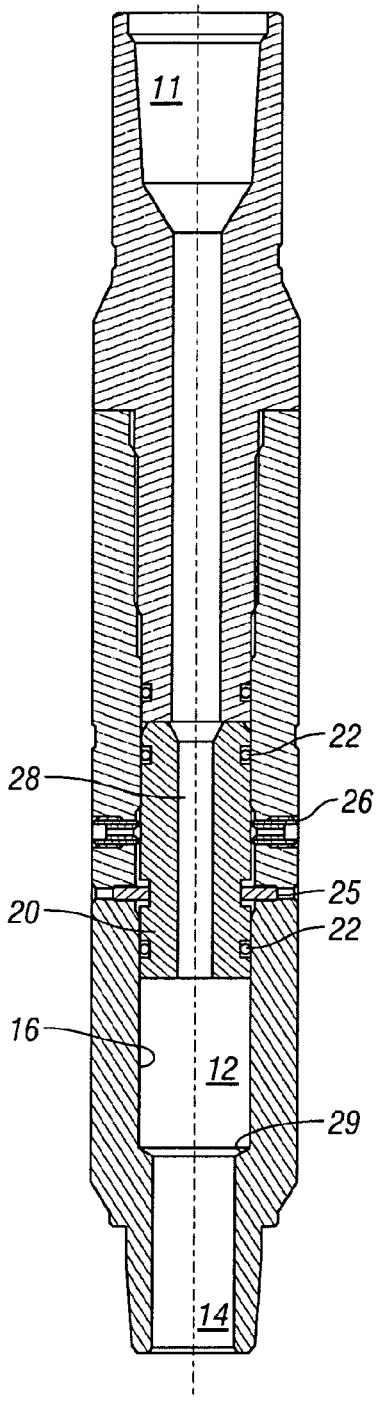
FIGS. 1A-1B illustrate an elevation view and a cross-sectional view of an embodiment of the perforating tool according to certain teachings of the present disclosure showing the sliding sleeve in a position that permits fluid communication through the tool.

One embodiment of the current invention pertains to an abrasive perforating device that contains a flow channel through which fluid may pass for operation of additional tools. FIG. 1A is a diagram of such a tool in the closed position. Fluid enters the device 10 (referred to herein as a perforating sub) through inlet 11, flows through channel 12 and exits the device through outlet 14. Additional tools may be connected to device 10 via threads or other connecting means near inlet 11 and outlet 14. The device 10 is designed so that inlet 12 is closer, along the path of the well, to the earth's surface than outlet 14.

Figure 1B:
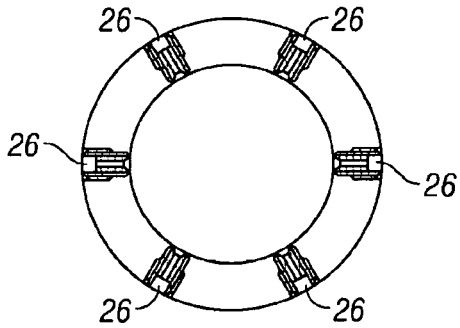

Device 10 contains a sleeve 20 that is disposed in the channel 12. Sleeve 20 may slide longitudinally within channel 12. Sleeve 20 has two sealing elements 22 that prevent fluid from passing between the sleeve 20 and the wall of the channel 16. Device 10 also contains one or more jet nozzles 26. FIG. 1B is a cross-sectional view illustrating one configuration of perforating jet nozzles.

Figure 3A:
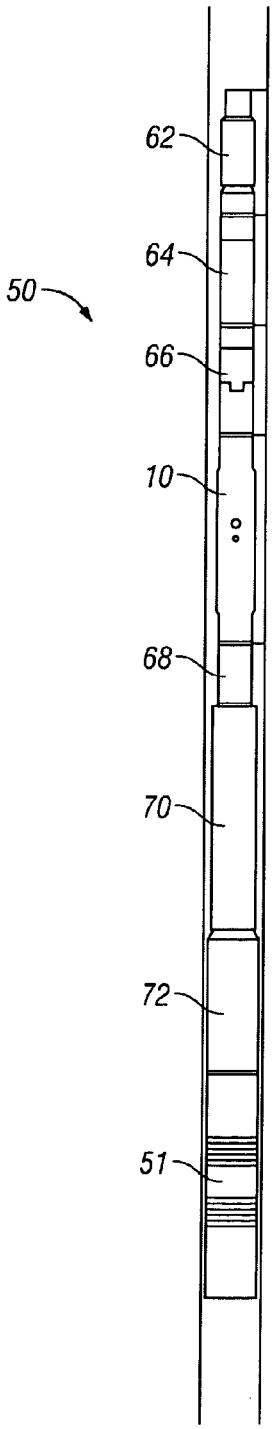
FIGS. 3A-3B illustrate an elevation view of the perforating tool of FIG. 1 in a tool string with a bridge plug at the bottom of the string and with the bridge plug set and disconnected from the string.
Figure 3B:
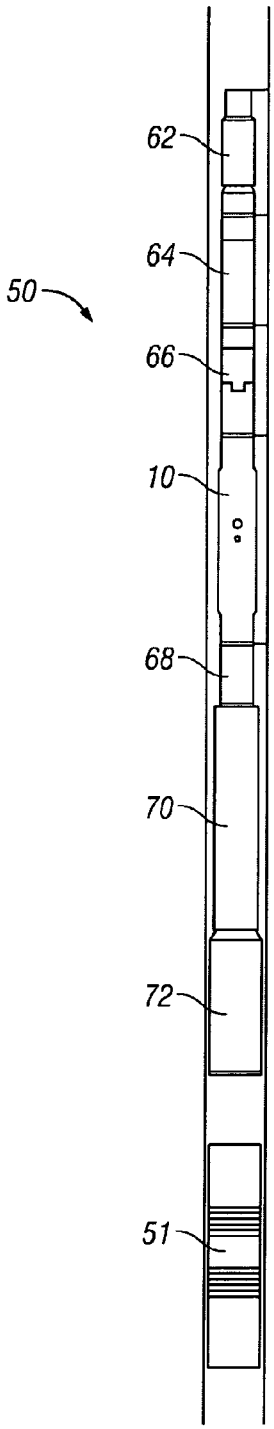

In one embodiment of the present invention, perforating sub 10 is attached to coiled tubing, directly or via additional tools, on the inlet end and to a hydraulic bridge plug on the outlet end. One arrangement for the tools is shown in FIGS. 3A and 3B. In FIG. 3A the perforating sub 10 of FIG. 1A is placed in a tool string 50 comprising a coiled tubing connector 62, back pressure valve 64, hydraulic disconnect 66, crossover setting tool 70, setting sleeve 72 and bridge plug 51. Each of the devices in the tool string 50 of FIG. 3A, other than the perforating sub 10, are well known to those of skill in the art. FIG. 3A shows a tool string of the present disclosure as it is run in to the hole. The coiled tubing is injected into the well until the bridge plug is adjacent to the desired location. Fluid is run into the coiled tubing, through the inlet 11, channel 12, outlet 14, and into the bridge plug 51. FIG. 3B shows the same tool string 50 after the bridge plug 51 has been set.

In one embodiment of the present invention, the fluid inflates the bridge plug such that the bridge plug forms a seal against the walls of the well. When the fluid pressure reaches a certain level, the bridge plug setting tool is activated to release the bridge plug from the tool string 50. Those skilled in the art will appreciate that any method for hydraulically inflating and releasing a bridge plug may be used in conjunction with this device, provided that any object conveyed through the device 10 must be small enough to pass through the opening 28 in the sleeve 20

The bridge plug 51 may also be set by other means that are well known in the art. Any bridge plug that is set in the well by controlling the fluid flow and/or pressure may be used as part of the present invention. As will further be appreciated by those of skill in the art, the bridge plug could be set with an explosion or through inflation as long as the plug once set is releasable from the perforating tool. For instance a simple shearing arrangement could be used.

When the bridge plug has been set and released, the abrasive perforating device 10 is positioned adjacent to the hydrocarbon bearing formation and a ball 21 is pumped down the coiled tubing into the device 10. The ball 21 must be of appropriate size and material to seal against the top of sleeve 20. The fluid pressure against sleeve 20 and the ball 21 is increased until sufficient pressure is obtained to shear the shear screws 25. When the shear screws are sheared, the hydraulic pressure against sleeve 20 and ball 21 causes the sleeve to slide longitudinally along channel 12.

Figure 2A:
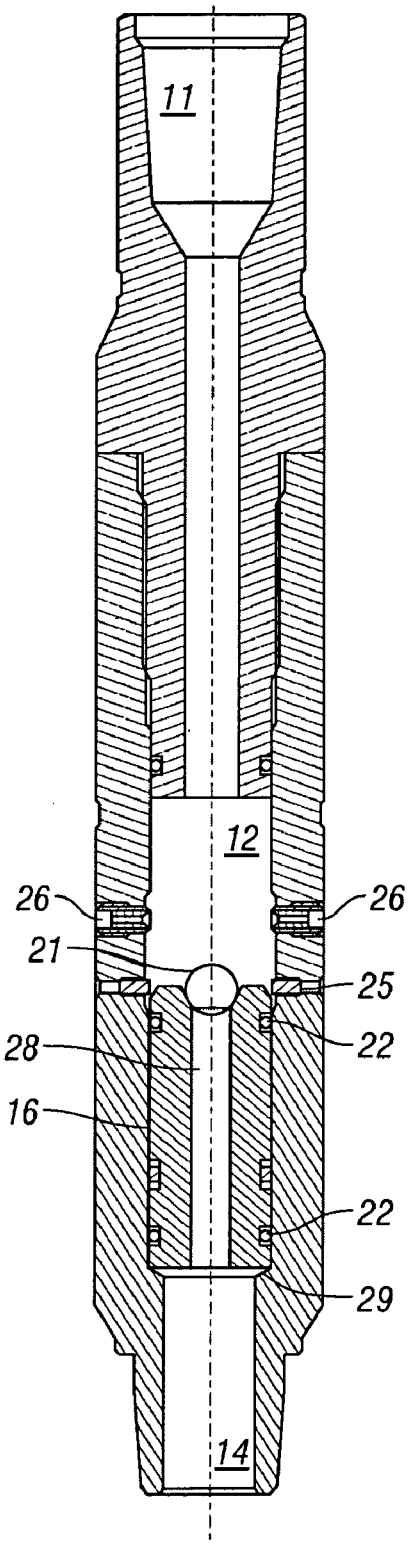
FIGS. 2A-2B illustrate an elevation view and a cross-sectional view of the embodiment of FIGS. 1A and 1B wherein the sliding sleeve has moved to a position where fluid communication is directed to the perforating orifices.

FIG. 2A shows device 10 with sleeve 20 in the open position after sliding along channel 12. The movement of sleeve 20 is stopped by shoulder 29. When sleeve 20 is in this position, as shown in FIG. 2A, the jet nozzles 26 are open to channel 12. As can be appreciated by those skilled in the art, the jet nozzles 26 contain a very narrow opening. Pressure in channel 12 forces fluid through the jet nozzles 26 to create a high velocity fluid stream. Solid particles, such as sand, are conveyed in this stream at or near the same velocity as the fluid. As the sand impacts on the casing or formation, it erodes the metal or rock and creates the desired perforation channels. In a preferred embodiment, 100 mesh sand is used as the abrasive to reduce tool erosion due to abrasive splash back in the well bore.

Figure 4:
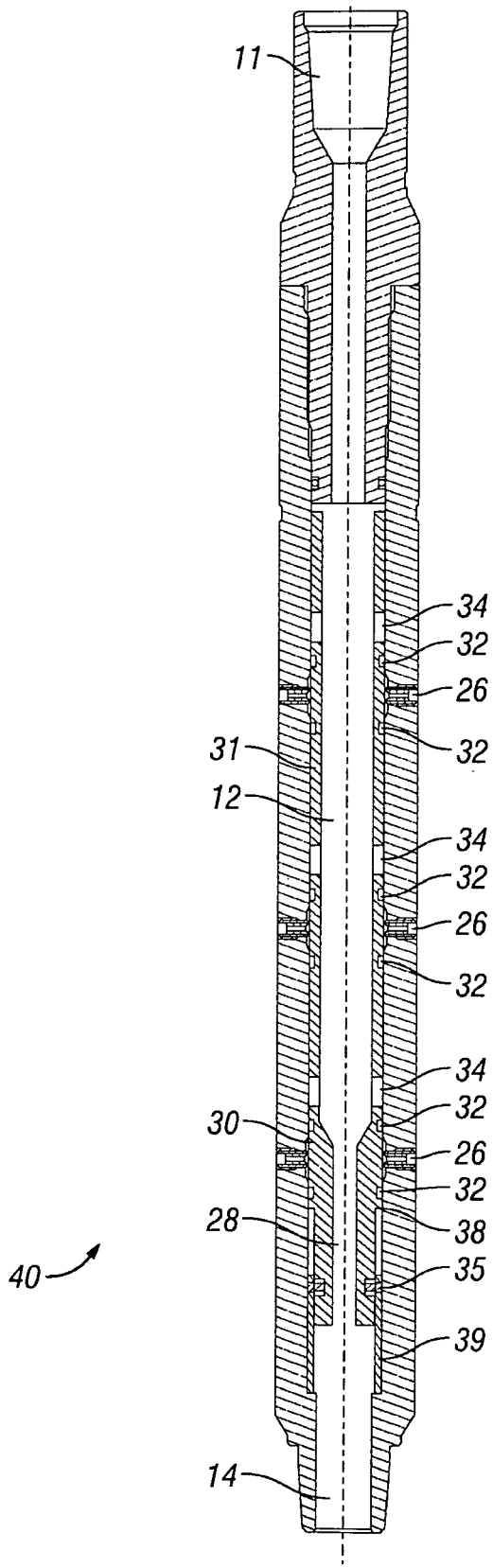
FIG. 4 illustrates an elevation view of an embodiment of the perforating tool according to certain teachings of the present disclosure showing the sliding sleeve in a position that permits fluid communication through the tool.

FIG. 4 shows an alternate abrasive perforating device that contains jet nozzles 26 at intervals along the length of device 40. The sleeve 30 is modified so that it contains an extension 31 along the channel 12. The extension contains a plurality of openings 34. Sealing elements 32 isolate each opening such that fluid may not flow between the extension 31 and the wall of the channel 16. When the ball 21 is engaged with the sleeve 30, fluid pressure causes the shear screws 35 to break and the sleeve 30 with its extension 31 to slide longitudinally in the channel 12. The sliding of sleeve 30 brings the openings 34 into line with the jet nozzles 26 and allowing fluid communication between channel 12 and the jet nozzles 26. This fluid communication allows pressure on the fluid in the channel 12 to produce the high velocity fluid stream necessary for abrasive perforation.

FIG. 4 illustrates an abrasive perforating device with six jet nozzles 26 within a single longitudinal section of the device. However, embodiments with as few as one jet nozzle in any single longitudinal section are envisioned. The maximum number of jet nozzles in a single longitudinal section is limited only by the operational requirements and mechanical limitations of the device.

Figure 5A:
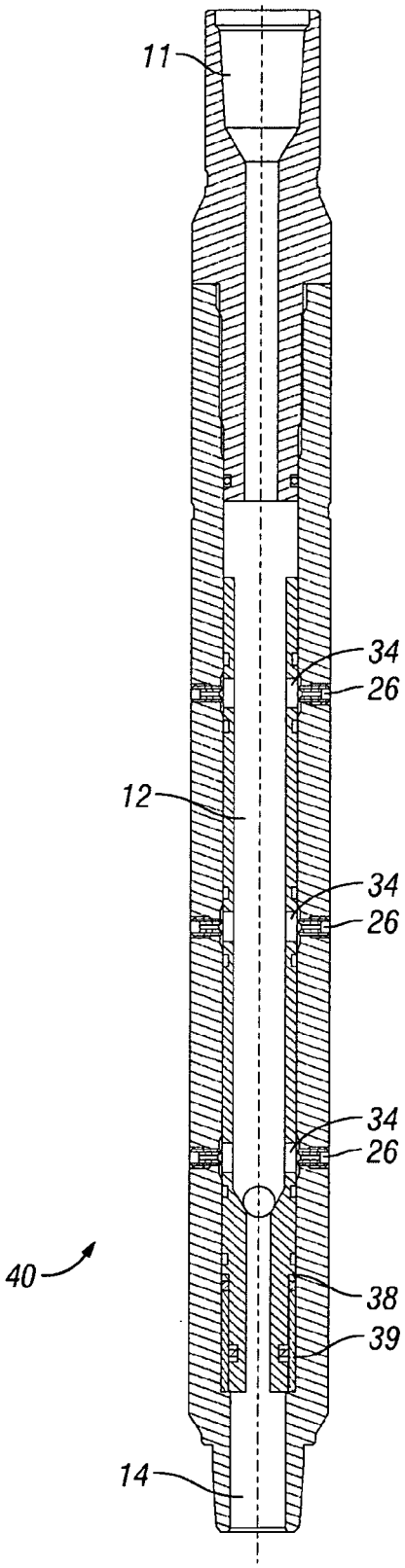
FIGS. 5A-5B illustrate an elevation view and a cross-sectional view of the embodiment of FIG. 4 wherein the sliding sleeve has moved to a position where fluid communication is directed to the perforating orifices.

FIG. 5A shows device 40 with sleeve 30 in position after sliding along channel 12. Sleeve 30 stopped by a shoulder 38 on sleeve 30 and a retaining washer 39. When sleeve 30 is in this position, the extension 31 is aligned in channel 12 so that the nozzles 34 in extension 31 are aligned with nozzles 26 in the body of device 40.

Figure 2B:
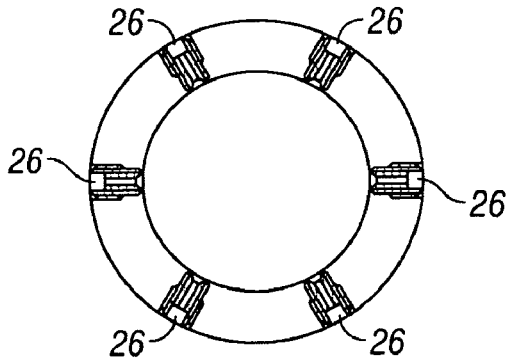
Figure 5B:
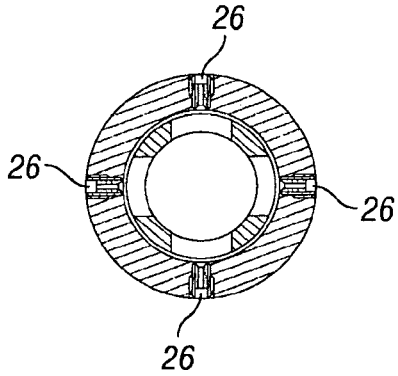

FIGS. 1B and 2B show six jet nozzles 26 in the cross sectional view and FIG. 5B shows 4 jet nozzles 26 in the cross sectional view. Those skilled in the art will appreciate that the present invention encompasses a range of jet nozzle configurations within a single cross section or across a number of cross sections. Depending on the requirements of the job, as few as one jet nozzle may be used.

By modifying the jet nozzles 26, further functionality can be obtained. For example, those skilled in the art will appreciate that removing or "popping out" the jet nozzles 26 will create openings in the device that allow fluid to flow back into the device and through the tubing to the wellhead. Such flow back may be useful for well test or other operations.

The jet nozzles 26 may be removed using excess pressure on the nozzles, by reducing the strength of the nozzle material with a chemical treatment, or other means. In addition, removal of the jet nozzles 26 may allow fracture, acidizing, consolidation, cementing, or other fluids to be pumped into the well after perforations are complete. A packer may be included in the tool string above the abrasive perforating device to facilitate operations involving these fluids. Such packers are well known in the art.

Figure 6:
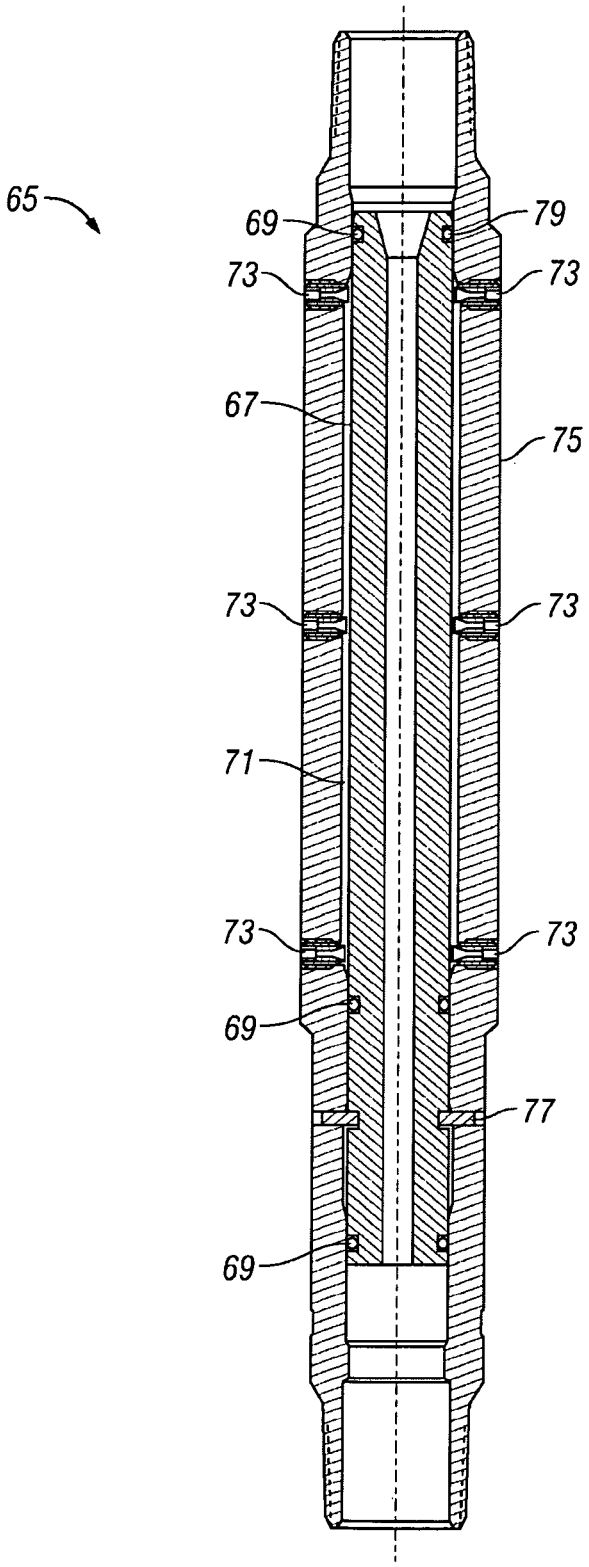
FIG. 6 illustrates an elevation view of an embodiment of the perforating tool according to certain teachings of the present disclosure showing a sliding sleeve configuration with three rows of jet nozzles.

FIG. 6 illustrates an embodiment of a three row jet nozzle embodiment of an abrasive perforating sub 65. In this embodiment, there is a sliding sleeve 67 that slides within outer body 75. When the perforating sub 65 is first run in the "open" position to allow fluid flow through the tool, the annular fluid channel 71 is sealed off with o-rings 69 on the sliding sleeve 67. The sliding sleeve 67 is held locked open by shear pins 77. When it is time to perforate, the sliding sleeve will be moved to the "closed" position by dropping a ball that seats on seat 79. Shear pressure is then applied to shear pins 77 and the whole sleeve 67 moves down until fluid begins to pass into annular channel 71 and out jet nozzles 73.

Figure 7:
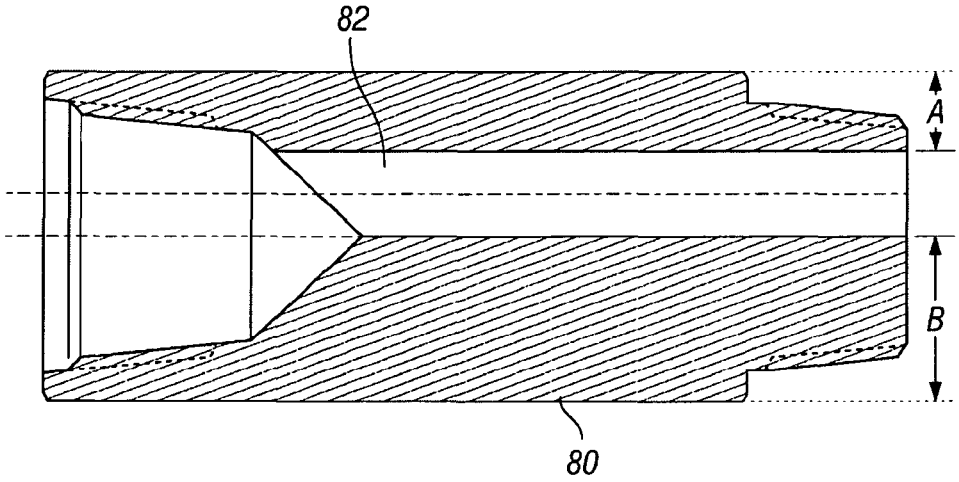
FIG. 7 illustrates a cross-sectional view of an eccentric weight bar according to certain teachings of the present disclosure.

FIG. 7 illustrates an embodiment of an eccentric weight bar 80 that can be included in the tool string utilizing any configuration of the disclosed perforating tool. By use of the eccentric weight bar 80, along with a standard swivel sub, the perforating tool can be made directional in wells that are not vertical. As seen in FIG. 7, eccentric weight bar 80 is designed so that the fluid channel 82 is not centered through the bar. This causes more metal to appear on one side of the fluid channel than on the other, as shown by A and B in FIG. 7. This causes the eccentric weight bar 80 to have naturally heavy side so that the side with the cross section shown as B on FIG. 7 will gravitate to the bottom side of a non-vertical wellbore. The fluid channel 82 is preferably bored as far off center as possible while still allowing the tool joint to meet API Specifications. The length of the eccentric weight bar 80 can vary depending on overall tool string requirements but a preferred length is five feet. By using such an eccentric weight bar 80, it allows for directional perforating as the device will align itself with the eccentric weight bar 80 as the bar notates due to gravity. The eccentric weight bar is preferably placed either just above or just below the perforating tool in the tool string shown in FIG. 3. A standard swivel sub can then be placed between the upper most device of either the eccentric weight bar, or the perforating sub, and the coiled tubing connector. As will be appreciated by those of skill in the art, the eccentric weight bar and the perforating sub could be combined into one unit. Further the perforating sub itself could be constructed with the counterbalance technique of the eccentric weight bar to provide alignment.

Figure 8:
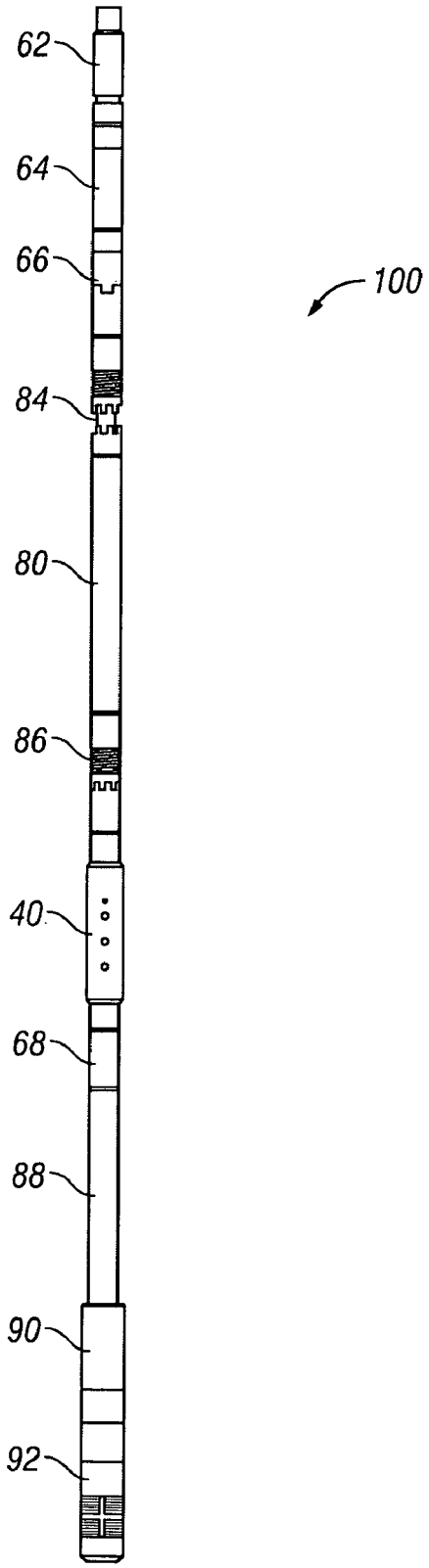
FIG. 8 illustrates an elevation view of the eccentric weight bar of FIG. 7 in a tool string.

FIG. 8 shows an illustration of a tool string 100 with the perforating sub 65 of FIG. 6 along with the eccentric weight bar 80 of FIG. 7. Common components to tool string 50 of FIG. 3 are labeled the same as those labeled in FIG. 3. The other components are a swivel sub 84, a lockable swivel sub 86, a hydraulic setting tool 88, a wireline adapter kit 90, and a composite plug 92. The illustrated tool string 100 is but one possible configuration of a tool string utilizing the eccentric weight sub and perforating sub of the present disclosure. Those of skill in the art will clearly configure tool strings to meet their particular needs without departing from the present disclosure.

What is claimed is:

1. A tool string comprising:

an eccentric weight sub characterized by a outer surface that is symmetrical to and coaxial with the tool string and that is free of projections that extend beyond the outer diameter of the sub, wherein the sub comprises an end-to-end longitudinal fluid channel configured to be continuous with the bore of the tool string when connected thereto; and an abrasive perforating device comprising:

a body;

a channel within the body;

a sleeve disposed within the channel;

at least one jet nozzle; and wherein the sleeve has a first position which prevents the flow of fluid through the at least one jet nozzle and a second position which allows the flow of fluid through the at least one jet nozzle.

2. The tool string of claim 1 where in the jet nozzles of the abrasive perforating sub are configured to cause directional perforating.

3. The tool string of claim 1 wherein the eccentric weight sub is rotatable in response to gravity.

4. A bottom hole assembly comprising at least a first tool and a second tool, wherein the first tool is an abrasive perforator, wherein the second tool is below the first tool and is hydraulically operable by flowing fluid through the abrasive perforator while the sleeve of the abrasive perforator is in the first position, and wherein the abrasive perforator comprises:

a body having an inlet and an outlet and defining a flow path therebetween;

a channel within the body forming part of the flow path;

a sleeve disposed within the channel;

at least one jet nozzle; and wherein the sleeve has a first position which prevents the flow of fluid through the at least one jet nozzle and permits flow of fluid only from the inlet through the outlet and a second position which blocks flow through the outlet and allows the flow of fluid through the at least one jet nozzle.

5. The bottom hole assembly of claim 4 wherein the second tool is a bridge plug.

6. The bottom hole assembly of claim 5 further comprising an eccentric weight sub characterized by a outer surface that is symmetrical to and coaxial with the tool string and that is free of projections that extend beyond the outer diameter of the sub, wherein the sub comprises an end-to-end longitudinal fluid channel configured to be continuous with the fluid path in the abrasive perforator.

7. The bottom hole assembly of claim 4 further comprising an eccentric weight sub characterized by a outer surface that is symmetrical to and coaxial with the tool string and that is free of projections that extend beyond the outer diameter of the sub, wherein the sub comprises an end-to-end longitudinal fluid channel configured to be continuous with the fluid path in the abrasive perforator.

8. The bottom hole assembly of claim 7 wherein the eccentric weight sub is above the first tool.

9. The bottom hole assembly of claim 7 wherein the eccentric weight sub is below the first tool.

10. A bottom hole assembly comprising at least a first tool and a second tool, wherein the first tool is an abrasive perforator, wherein the second tool is an eccentric weight sub characterized by a outer surface that is symmetrical to and coaxial with the tool string and that is free of projections that extend beyond the outer diameter of the sub, wherein the sub comprises an end-to-end longitudinal fluid channel configured to be continuous with the fluid path in the abrasive perforator, and wherein the abrasive perforator comprises:

a body having an inlet and an outlet and defining a flow path therebetween;

a channel within the body forming part of the flow path;

a sleeve disposed within the channel;

at least one jet nozzle; and wherein the sleeve has a first position which prevents the flow of fluid through the at least one jet nozzle and permits flow of fluid only from the inlet through the outlet and a second position which blocks flow through the outlet and allows the flow of fluid through the at least one jet nozzle.

* * * * *